US006226827B1

(12) United States Patent
English, Jr.

(10) Patent No.: US 6,226,827 B1
(45) Date of Patent: May 8, 2001

(54) GOLFER'S PERSONAL CLEANING DEVICE

(76) Inventor: James B. English, Jr., 4564 Viro Rd., La Canada, CA (US) 91011

( * ) Notice: Subject to any disclaimer, the term of this patent is extended or adjusted under 35 U.S.C. 154(b) by 0 days.

(21) Appl. No.: 09/184,230

(22) Filed: Nov. 2, 1998

(51) Int. Cl.[7] ..... A47K 7/00

(52) U.S. Cl. ..... 15/118; 15/104.93; 15/209.1; 15/210.1

(58) Field of Search ..... 15/104.93, 118, 15/209.1, 210.1

(56) References Cited

U.S. PATENT DOCUMENTS

| | | | | |
|---|---|---|---|---|
| 1,702,172 | * | 2/1929 | Rennie . | |
| 2,530,746 | * | 11/1950 | Wetherby . | |
| 2,778,044 | * | 1/1957 | Mikulski | 15/118 |
| 2,968,825 | * | 1/1961 | Wetherby | 15/118 |
| 5,408,718 | * | 4/1995 | Sadovsky | 15/118 |
| 5,639,532 | * | 6/1997 | Wells . | |
| 5,671,498 | * | 9/1997 | Martin | 15/104.93 |
| 5,761,761 | * | 6/1998 | An . | |
| 5,813,080 | * | 9/1998 | Hendren | 15/118 |
| 5,918,341 | * | 6/1999 | Hale | 15/104.93 |

FOREIGN PATENT DOCUMENTS

| | | | | |
|---|---|---|---|---|
| 1100988 | * | 1/1968 | (GB) | 15/104.93 |

* cited by examiner

*Primary Examiner*—Randall E. Chin
(74) *Attorney, Agent, or Firm*—Aquilino, Welsh & Flaxman

(57) ABSTRACT

A golf towel for cleaning a golfer's hands, golf ball, and equipment for attachment to the clothing of the golfer, having a first dry cleaning surface; a second moisturized cleaning element in the form of a moisture retaining region located inwardly of the dry cleaning surface on the towel. The towel may include a third abrasive cleaning surface for removal of hard to clean stains and dirt, and/or a fastener for attaching the towel to the clothing of a golfer.

13 Claims, 6 Drawing Sheets

FIG. 3
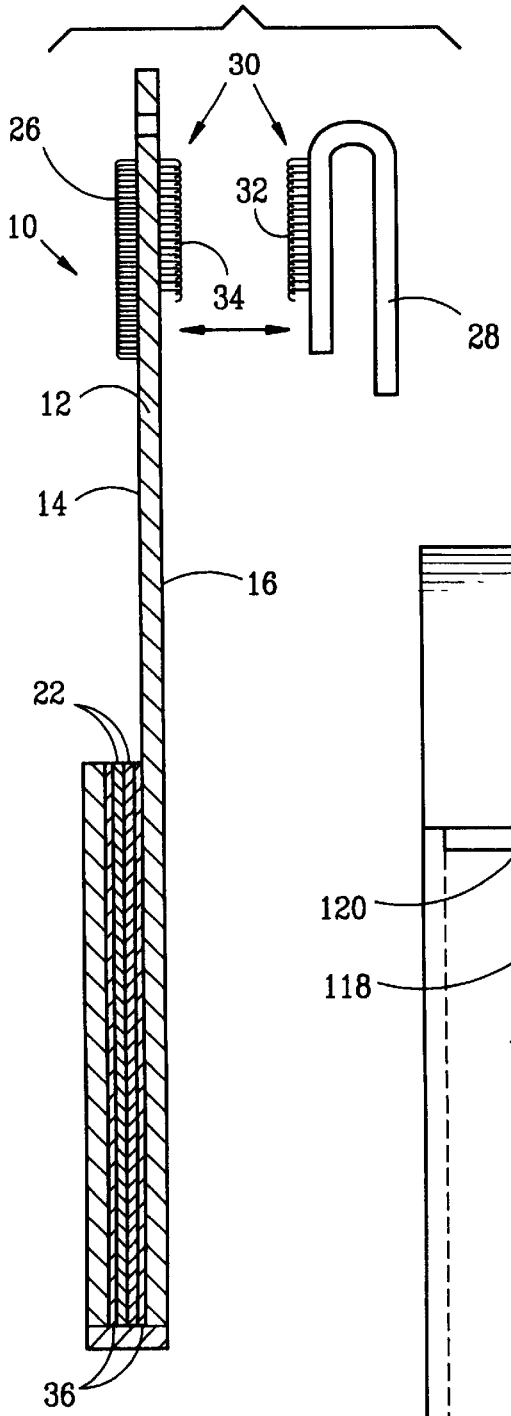
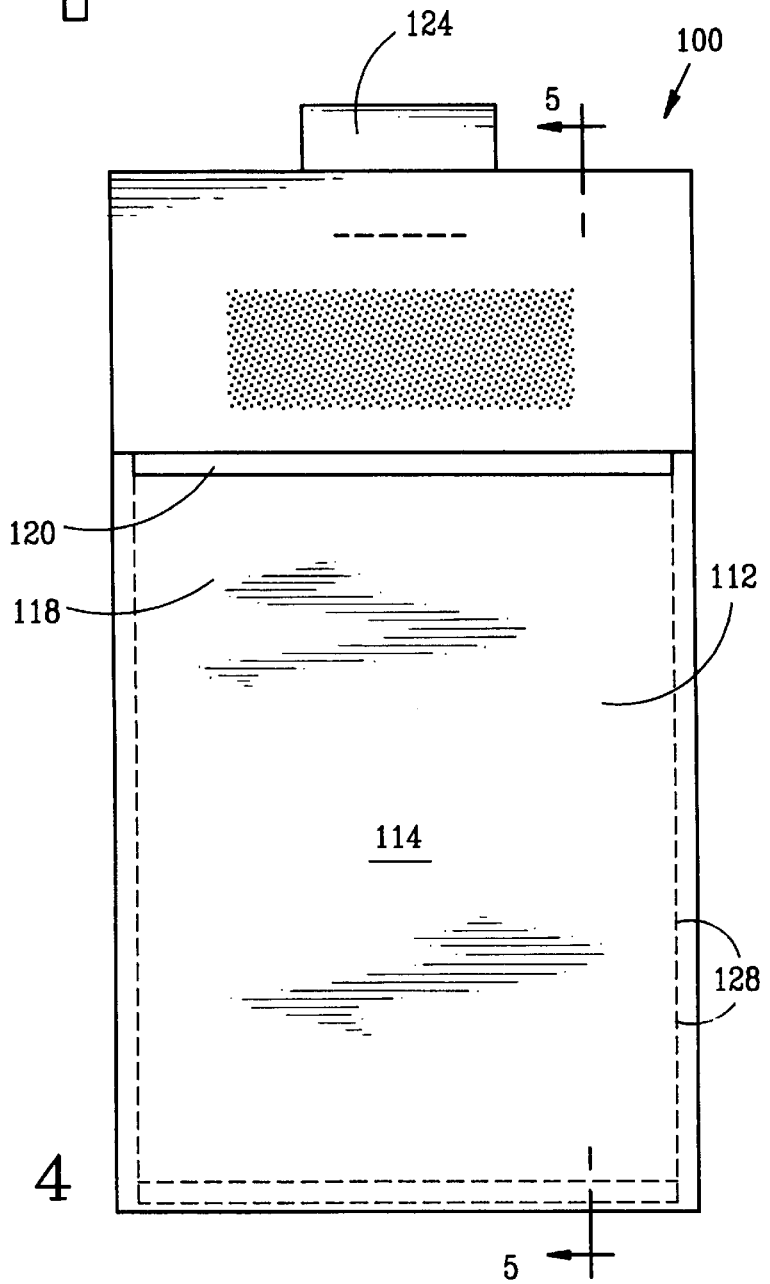
FIG. 4

GOLFER'S PERSONAL CLEANING DEVICE

BACKGROUND AND SUMMARY OF THE INVENTION

The present invention relates to a cleaning device and in particular a cleaning device for use by a golfer when playing a game of golf.

In playing the game of golf, it is usual for residual dirt and grass stains to be imparted to a golfer's golf ball, golf equipment and hands while traversing the rough terrain normally encountered on a golf course. This requires that a golfer diligently clean his golf ball, golf equipment and hands in order to avoid visual distractions and to eliminate errant ball flight and rolls as a golfer plays the game. Current practice allows a golfer to clean a ball after it comes to rest on a putting green. Of course, a golfer may clean his hands or equipment at any time on the golf course during the play of a round.

A mechanical golf ball cleaner may be provided at the teeing ground, and is not available for use after a ball reaches a putting surface. For this reason, most often a large dry golf towel is attached to a golf bag or a golf cart for the purpose of cleaning a golf ball before a putting stroke is made. The golf bag or cart is usually located a significant distance from the ball when it rests on the putting surface where it may be lifted and cleaned. As a result a golfer may apply saliva to the ball to clean it and further may use his clothing to wipe the ball dry and/or clean his hands. Alternately the golfer must take the time to return to the golf bag or cart located some distance away for the towel to clean or dry the ball and/or his hands. Few golfers ever carry a large, dry golf towel to the green from the golf bag or cart. Still fewer golfers carry a moistened towel on the golf course and those that do must wet the towel from a drinking facility or from a lake, stream or similar body of water located on the course, which almost always requires a distracting side trip to wet the towel.

There are a number of prior art patents relating to golf towels and other similar products. For example, U.S. Design Pat. No. 330,140 to Lerner shows a golf towel attached to a golf bag having an inside pocket to wipe off golf clubs and balls. U.S. Design Pat. No. 339,951 to Parkinson et al. shows a sports towel with a pocket. U.S. Pat. No. 5,012,543 to Lewis, Sr. shows an athletic towel made from terry cloth fabric having a hook and loop fastener for securing the towel around the user's waist and further includes a pocket attached to the drying surface. U.S. Pat. No. 5,443,880 to Wike shows a towel with a compartment or pocket for holding articles. The pockets may be lined with water-proof or water-repellent material. U.S. Pat. No. 5,147,703 to Provost et al. shows a golf towel set including a main towel and an accessory towel which is releasably attached to the main towel. U.S. Pat. No. 5,131,112 to Cervini shows a golfer's ball cleaner including a cylindrical casing for a small towel which is used either wet or dry and attached to the golfer's belt or clothing or to a golf bag using a clip. U.S. Pat. No. 5,553,345 to Bell shows a clip-on dry towel adapted to hook to a golfer's waistband or belt.

The present invention relates to an improved golfer's cleaning device having advantages not shown or suggested by the known prior art. The cleaning device of the present invention serves to clean a golf ball, a golfer's hands, and golf equipment for removing grass stains, dirt and other debris. Preferably the cleaning device includes an integral or separately affixed fastener implement which maintains the cleaning device conveniently affixed to a pocket, waistband or belt of a golfer. The cleaning device includes a large dry cleaning surface using, for example, a conventional terry cloth sheet of material or the like. The cleaning device further includes a contiguous or separately attached moisture retaining region which is located interiorly of the first dry cleaning surface and constructed in the shape or form of a pocket, disc, sponge, tube or other folded structure which serves to harbor moisture in an interior portion of the cleaning device. Preferably the moisture retaining region is not exposed to the outside air and to the golfer and his clothing.

A more abrasive, coarse cleaning surface may be attached to the dry cleaning surface where it is readily accessible for use to remove thicker layers of dirt or grass stains. The cleaning device includes a fastening element permanently or removably attached to an upper surface which allows for attaching and detaching of the cleaning device to a golfer's belt, waistband or other portion of his clothing. Preferably the cleaning surface provides a substantial area for promotional marks such as advertisements, logos and/or designs.

The present invention includes another embodiment wherein the cleaning surfaces are affixed to a wallet shaped, folded substrate, which may be rigid or flexible. This embodiment includes a dry cleaning region and moist cleaning region formed on opposite interior surfaces of the folded substrate and separated by a non-porous boundary.

Among the objects of the present invention are a provision of an improved golfer's cleaning surface having a plurality of cleaning surfaces with different moisture retaining and abrasive characteristics.

Another object of the present invention is the provision of a golf cleaning device which may be attached directly to a golfer's belt, waistband or other portion of his clothing to be carried with the golfer and available at all times.

Still another object of the present invention is the provision of a golfer's cleaning device having both a dry cleaning surface and a pre-moistened region formed interiorly of the dry cleaning surface to facilitate the cleaning of a golfer's golf ball, equipment or hands.

A still further object of the present invention is the provision of a golf cleaning device having an integral or removably attached fastener device enabling the golfer to readily attach the cleaning device to his clothing.

These and other objects and advantages of the invention will be realized and obtained by means of the invention structure particularly pointed out in the following specification and drawings.

It is understood that the foregoing general description and following detailed description are exemplary and explanatory only and are not restrictive of the invention as claimed.

BRIEF DESCRIPTION OF THE DRAWINGS

FIG. 3 is a side sectional view thereof taken along the line 3—3 of FIG. 2.

FIG. 4 is a front surface view of a second embodiment of the present invention.

DETAILED DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 2:
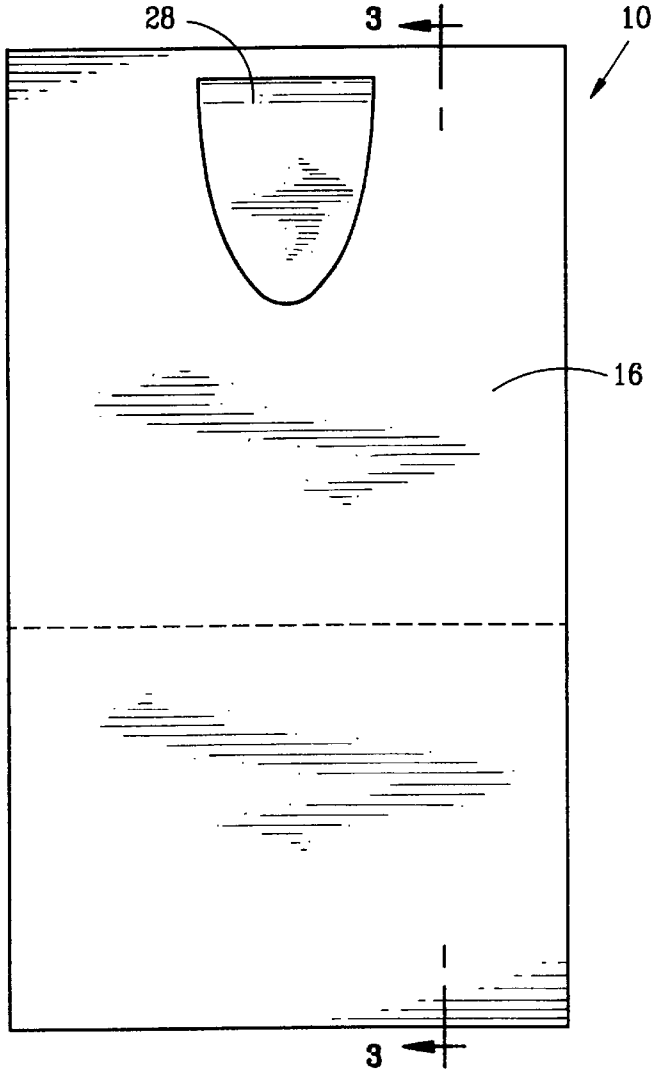
FIG. 2 is a rear surface view thereof.
Figure 1:
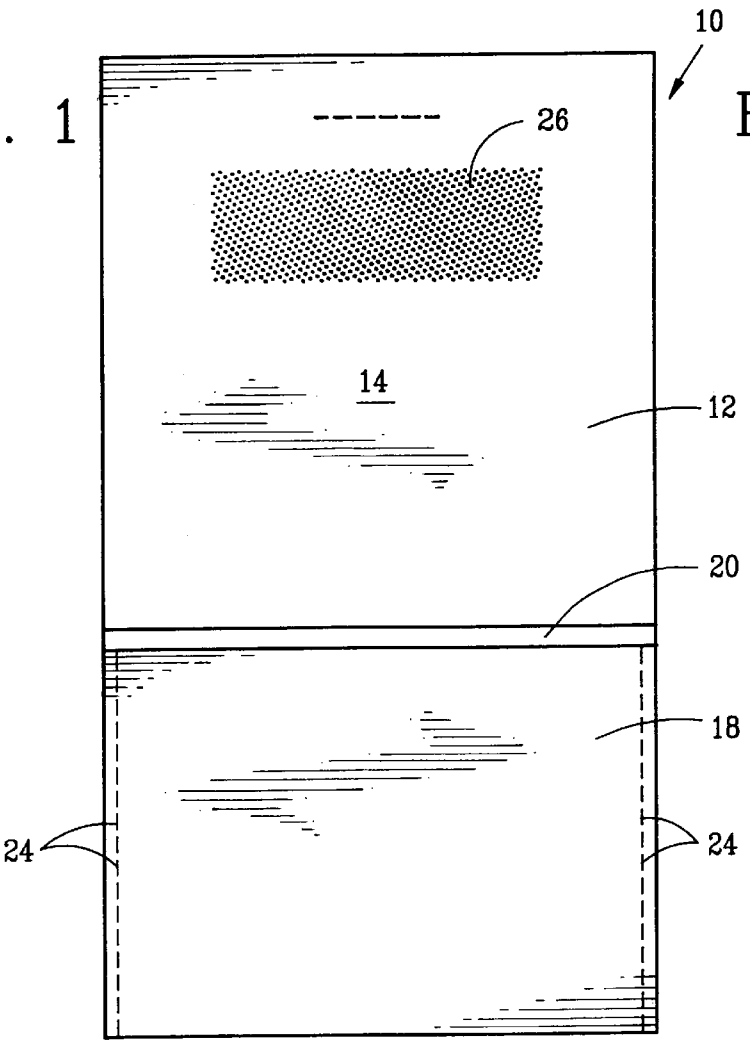
FIG. 1 is a front surface view of the cleaning device in accordance with present invention.

Referring the drawings, FIGS. 1–3 illustrate a first embodiment of a golf cleaning device 10 of the present invention, including a dry cleaning area 12 having a front 14 and rear 16 formed of a terry cloth or similar towel like material 10. The lower portion of the cleaning device 10 includes a moisturized cleaning region formed by a pocket 18 having an opening 20 with a moisture retaining element 22 within the pocket 18 formed by a moisture retaining material which form the inner walls of the pocket 18. In this embodiment, the pocket 18 is formed by the dry cleaning area 12 being folded back upon itself and secured along the edges of the cleaning device 10 by stitches 24. The cleaning device 10 includes a third coarse cleaning surface 26 which may be formed from a rigid abrasive material, for example a hook type pad of a separable fastener. This coarse cleaning surface 26 is attached to the dry cleaning area 12 and is much more coarser and abrasive for removal of thicker layers of dirt and or stains. This coarse cleaning surface 26 may be located on either side of the towel.

The cleaning device 10 includes an integral fastener hook 28 which may be made of a rigid or malleable material having a hook or clip shape for attachment to a golfer's pocket, waistband or belt, thus securing the cleaning device 10 to the personal attire of the individual golfer, thereby allowing him to carry the cleaning device 10 with him at all times for easy access thereof. The fastener hook 28 is removably attached using a hook and loop separable fastener 30 including a hook fastener pad 32 attached to the fastener hook 28 cooperating with a loop fastener pad 34 attached to the rear 16 of the cleaning device 10.

FIG. 3 illustrates a cross-sectional view taken along the line 3—3 of FIG. 1 wherein the dry cleaning area 12 is viewed contiguously to the moisture containing pocket 18. The exterior of the moisture containing pocket 18 is an extension of the dry cleaning area 12, folded over upon itself and stitched at the edges to form the pocket 18 and preferably would be of the same material, for example terry cloth or similar towel cloth. However, it is also contemplated that the pocket 18 may be formed from a separately cut piece sewn onto the towel. The interior region of the moisture containing pocket 18 is formed with a layer of absorbent moisture retaining material 22 having a mildly abrasive surface, and sufficient moisture retaining properties to retain moisture within the pocket 18. The pocket 18 is lined with a second layer 36 of moisture impermeable material, such as polyethylene, to retain the moisture with the confines of the pocket 18.

In use, the pocket 18 is filled with water or a solution of cleaning fluid and the pocket 18 is permitted to close naturally due to the proximity of the side wall surfaces of the pocket 18 to the dry cleaning area 12 maintained by the stitching along the edges of the pocket 18. The cleaning device 10 is preferably attached to the golfer's clothing, for example his belt or rear pocket by the fastener hook 28. A golfer has several options for using the cleaning device 10. He may use the dry cleaning area 12 to remove moisture or water from his golf ball, hands, or his golf equipment. Should the golfer wish to remove excess dirt or stains from any of these, the article to be cleaned is simply placed within the pocket 18 where the article is wetted by the moisture retained therein and is suitably rubbed or abraded by the inner moisture retaining layer 22 within the pocket 18 until the adverse material is removed. Should the golfer encounter heavy stains or layered dirt, the article to be cleaned may be first moistened or simply rubbed by the more coarse abrasive cleaning pad 26 before insertion into the pocket 18.

Figure 5:
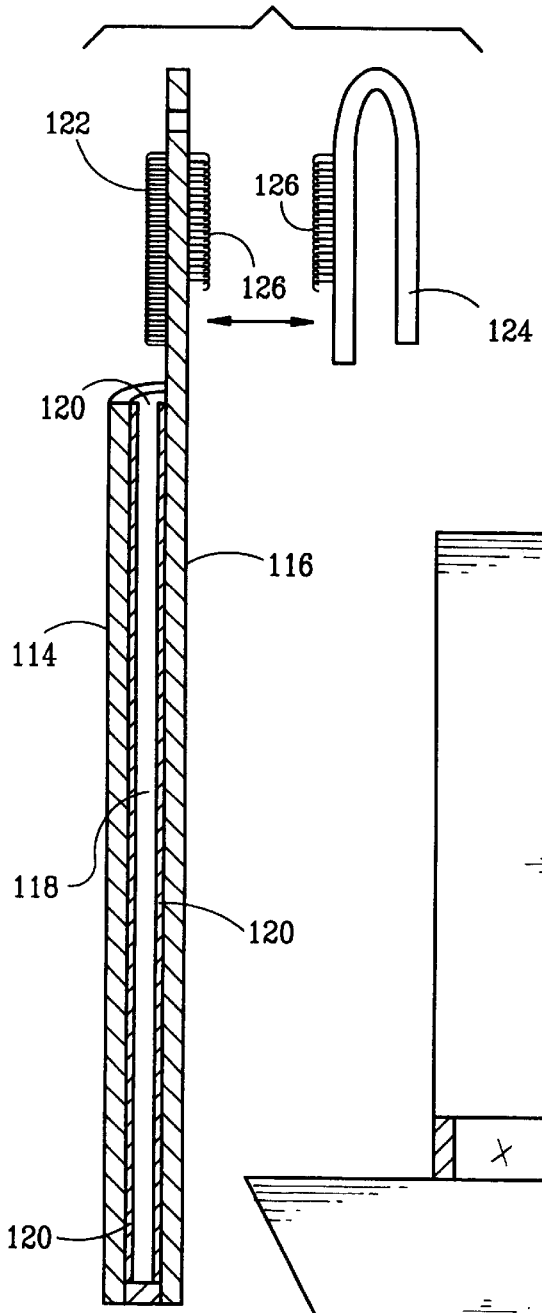
FIG. 5 is a is a side sectional view thereof taken along the line 5—5 of FIG. 4.

FIGS. 4 and 5 illustrate a second embodiment of a golfer's cleaning device 100 in accordance with the present invention. A dry cleaning surface 112 is provided on both the front 114 and the rear 116 of the cleaning device 100 and is characterized by a large pocket 118 which retains moisture. The pocket 118 extends at least a majority of the overall length of the device 100 and has an opening 120 for access to the interior of the pocket 118. The inner region of the pocket 118 includes a layer of moisture retaining material 120. Another layer of moisture impermeable material (not shown), may be provided between the moisture retaining material and the outer dry cleaning surfaces 112. This embodiment also includes a coarse, more abrasive cleaning surface 122 and a fastener hook 124 which is used to attach the cleaning device 100 to the clothing of the golfer, as described with reference to the embodiment of FIGS. 1–3. Preferably the fastener hook 124 is secured to the rear panel 116 of the cleaning device by a separable fastener 126. Alternately the fastener hook 124 may be glued, sewn or otherwise attached. The outer layer of the pocket 118 may be formed by overlapping the dry cleaning surface 112 and attaching by means of stitches 128.

Figure 6:
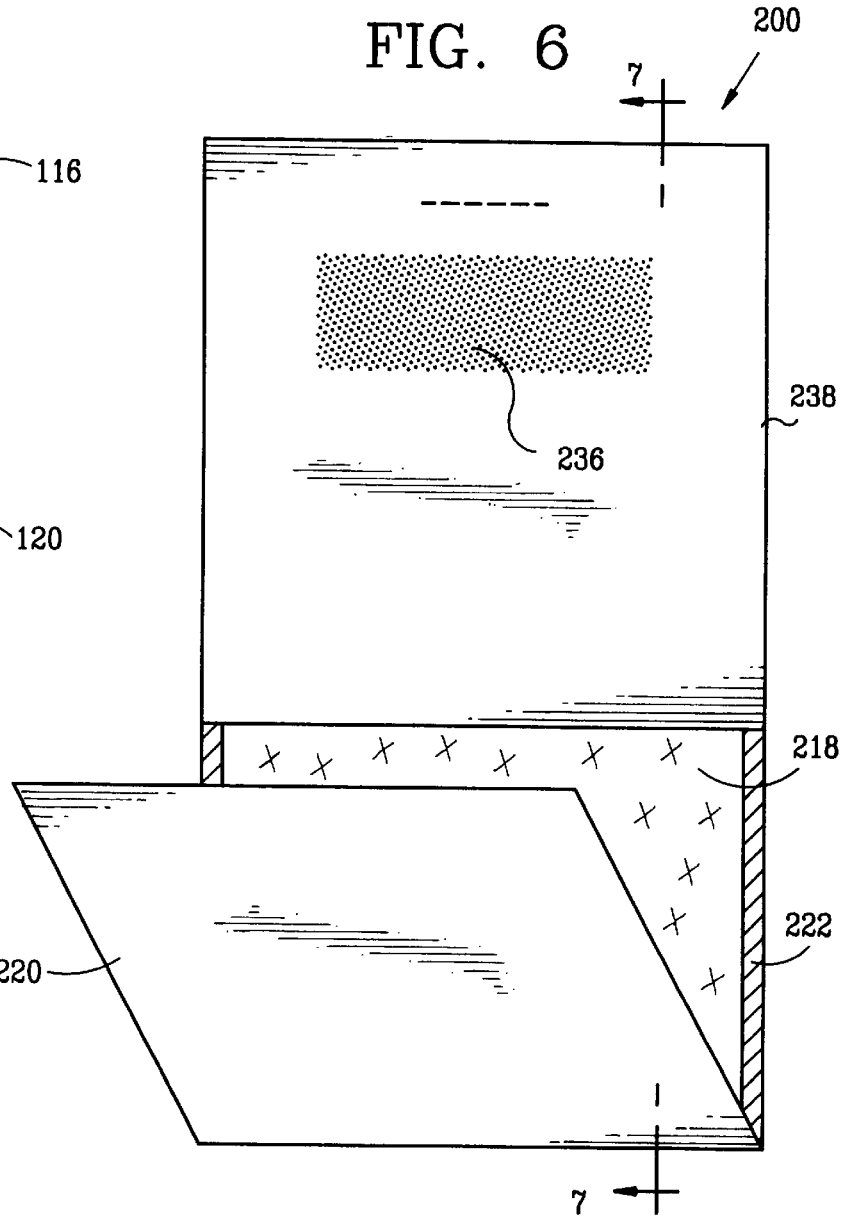
FIG. 6 is a front surface view of a third embodiment of the present view.
Figure 7:
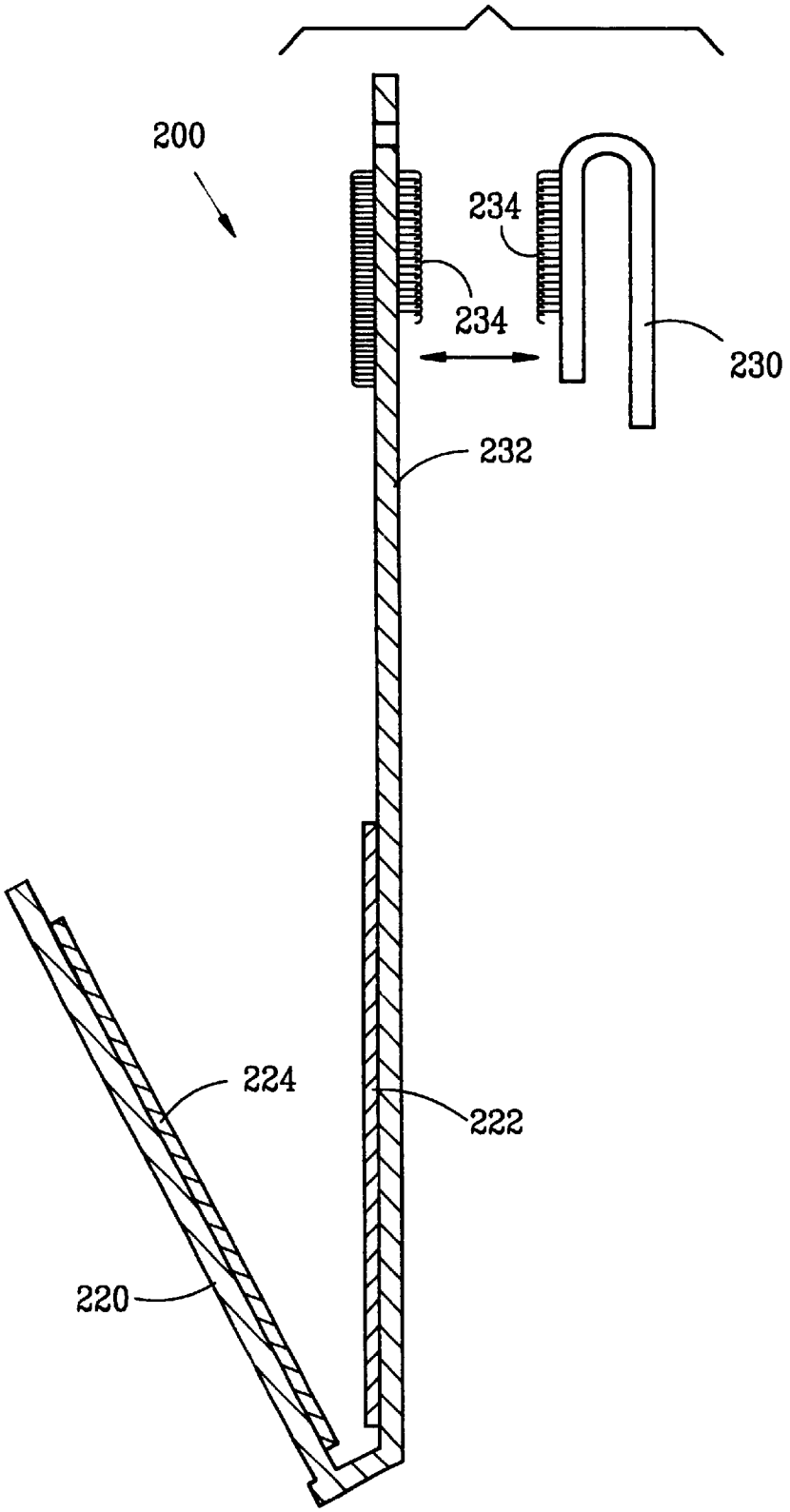
FIG. 7 is a is a side sectional view thereof taken along the line 7—7 of FIG. 6.

FIGS. 6 and 7 show a third embodiment of a golf cleaning device 200 in accordance with the present invention which is similar in design to the devices described hereinabove with the exception that the moisture retaining region is formed of a folded over pocket 220 secured by strips of hook and loop type separable fasteners 222 and 224 and an interior moisture retaining material 218. This enables the pocket 220 to be opened allowing for easy access to the interior when the pocket 220 is being moisturized. Opening the separable fastener elements 222 and 224 also permits the golf cleaning device 200 to be dried more easily when it is no longer being used. A hook fastener 230 is secured to a rear panel 232 of the device 200 by another separable fastener 234. An abrasive cleaning surface 236 is mounted on a front panel 238 of the device 200.

Figure 8:
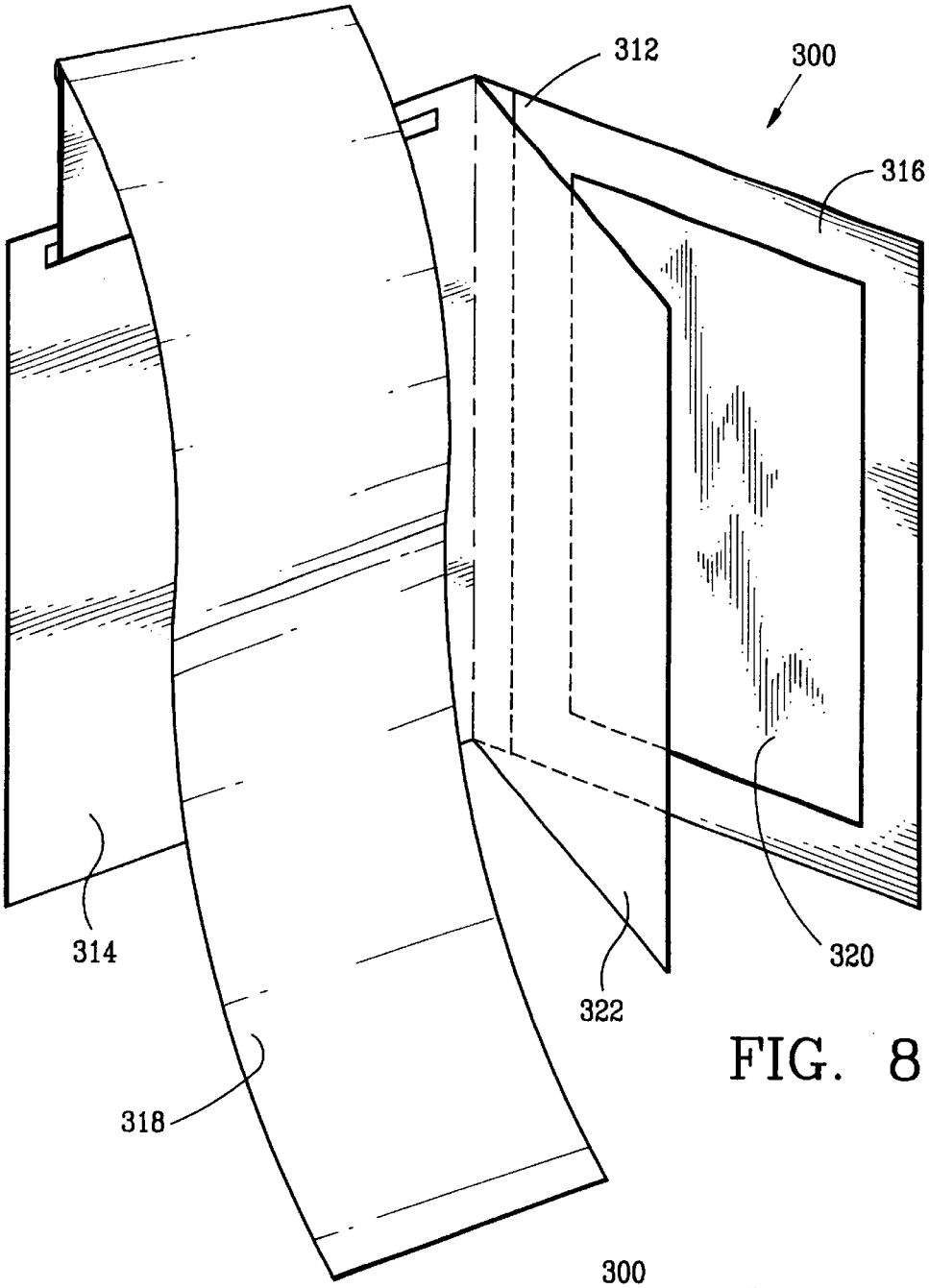
FIG. 8 is a perspective view of a fourth embodiment of the present invention.
Figure 9:
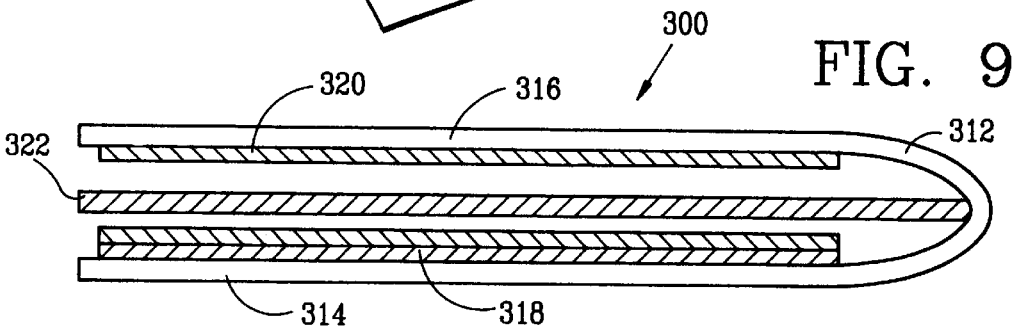
FIG. 9 is a side sectional view of the embodiment of FIG. 8 in a folded condition.

FIGS. 8 and 9 show still another embodiment of a golf cleaning device 300 in accordance with the present invention and includes a rigid or semi-rigid folded substrate 312 having a front panel 314 and rear panel 316 which are folded over so as to abut each other in a closed relationship. The front panel 314 is provided with a dry cleaning area 318 formed by a towel cloth which may be folded over upon itself. Preferably the towel would be attached to the inner portion of the panel by means of a separable hook and loop type fastener (not shown). The opposite panel 316 is provided with a pad 320 which is moisture retaining and may be a layer of semi-abrasive water retentive material either intricately formed or attached to the panel 316. A spacer sheet 322 of polyethylene material preferably separates the dry towel from the moisture retaining surface. Preferably the water retention material moisture pad 320 is removable and is attached to the semi-rigid rear panel 316. This embodiment may be carried in a user's pocket or the pocket of a golf bag so that it is readily available for a golfer's use.

Figure 11:
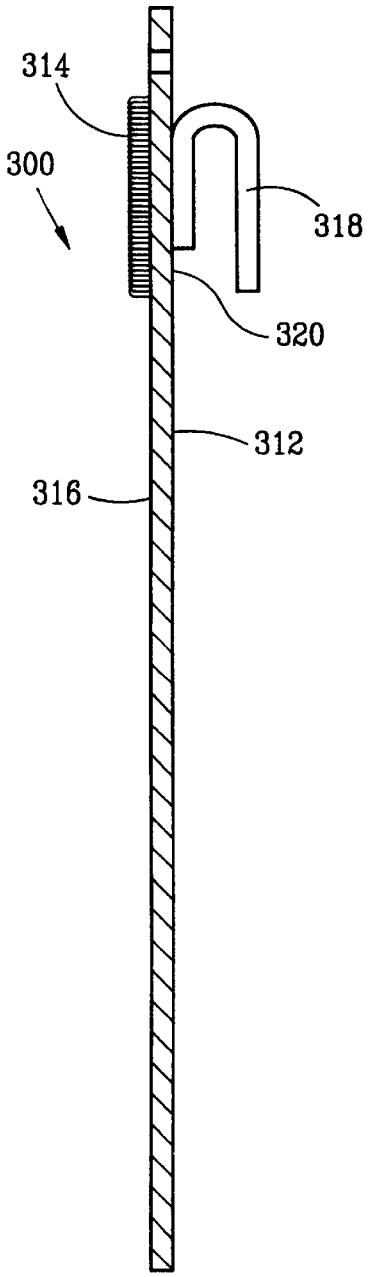
FIG. 11 is a side sectional view of said fifth embodiment.
Figure 10:
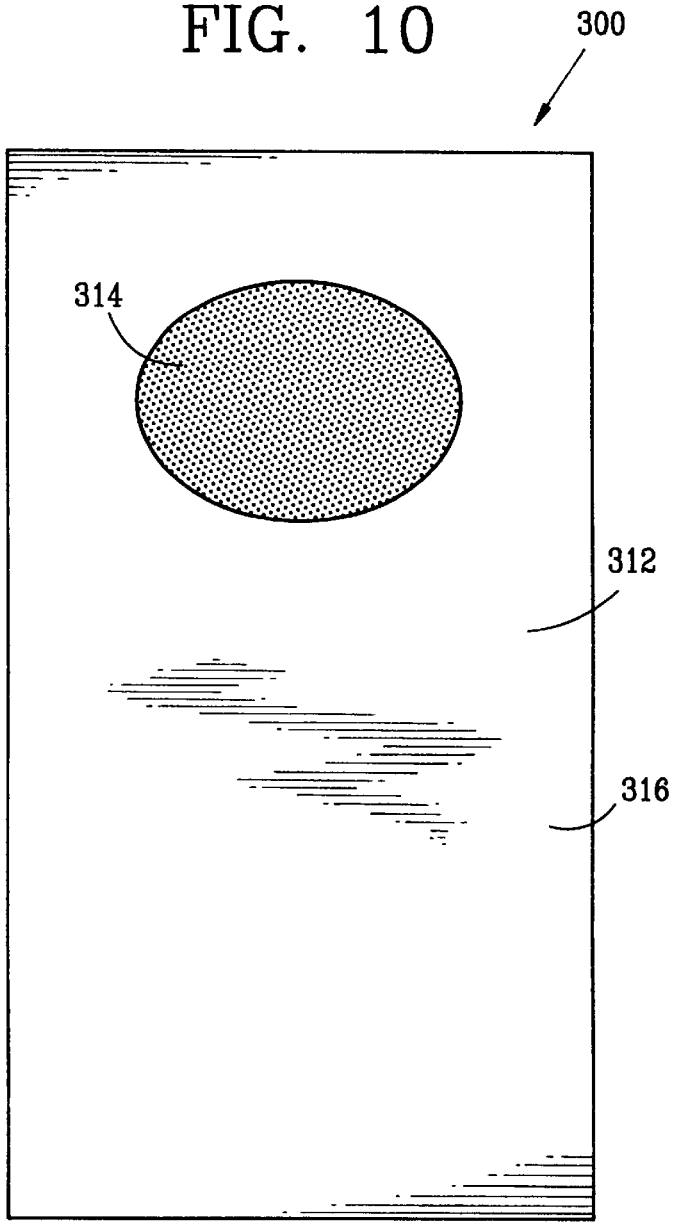
FIG. 10 is a front surface view of a fifth embodiment of the present invention.

FIGS. 10 and 11 show another embodiment of a golfer's cleaning device 300 in the form of a dry cleaning surface 312 with a disc shaped moisture retaining cleaning surface 314 on a front panel 316 thereof. The moisture retaining cleaning surface 314 may be attached to the dry front panel 316 of the dry cleaning surface 312 by a clip, separable fastener or other suitable attachment device. The moisture retaining cleaning surface 314 is contiguous to the dry cleaning surface 312 and harbors moisture within the structure of the material forming the moisture retaining surface 314 such as a sponge or absorbent gel. The moisture in the moisture retaining surface 314 is transferred to a golf ball, golf club or the golfer's hands by pressing the moist surface against the object to be cleaned or the object may be likewise pressed against the moisture retaining surface 314. Since the moisture is housed within the structure of the material forming the moisture retaining surface 314, the outer surface may be dry, however when the surface is depressed the moisture will wick to the outer surface for cleaning. A fastener hook or clip 318 is rigidly attached to a rear surface 320 of the cleaning device 300.

Whereas the inventions have been principally described with a rectangular shaped cleaning device it will be appreciated that the various combination of features may be incorporated on a cleaning device without departing from the scope of the invention.

While various preferred embodiments have been shown and described, it will be understood that there is no intent to limit the invention by such disclosure, but rather it will be apparent to those skilled in the art that changes, modifications and variations of the disclosed embodiments may be made in the cleaning device of the present invention, rather the application is intended to cover all modifications and alternate constructions falling within the spirit and scope of the invention as defined in the appended claims.

What is claimed is:

1. A golf towel for cleaning a golfer's hands, golf ball, and equipment for attachment to the clothing of the golfer, comprising: a first, outer dry cleaning surface; said surface having a front and rear side and an upper edge, a lower edge, and side edges; a pocket integrally formed with said first dry cleaning surface and located at said lower edge, said pocket having an interior surface forming a second, moisturized cleaning surface, said pocket having an opening exposing said interior surface; said second moisturized cleaning surface including at least one interior layer of moisture retaining material within said pocket forming a moisture retaining region; said pocket further including a moisture impermeable material between said first dry cleaning surface and said second moisturized cleaning surface; said pocket being formed by a lower portion of said first dry cleaning surface being folded over upon itself forming front and rear sides of said pocket, with said moisture impermeable material and said second moisturized cleaning surface located therebetween; said pocket being further defined by connected edges extending along said side edges of said towel between said opening of said pocket and said lower edge of said first, outer dry cleaning surface.

2. The golf towel of claim 1 wherein said moisture impermeable material is a plastic sheet.

3. The golf towel of claim 1 further including an attaching means for attaching said towel to the clothing of a golfer; said attaching means located adjacent said upper edge approximately midway between said side edges; said attaching means being further defined as a hook attached to said towel; said attaching means further including a separable fastener for removably attaching said towel from said hook permitting said towel to be removed from the clothing of said golfer.

4. The golf towel of claim 1 wherein said connected edges further include stitches attaching said edges and forming said pocket therebetween.

5. The golf towel of claim 1 wherein said first cleaning surface is formed of a soft cloth fabric.

6. The golf towel of claim 5 wherein said fabric is generally rectangular in shape.

7. The golf towel of claim 1 further including a third cleaning surface formed of an abrasive and roughened cleaning material.

8. The golf towel of claim 1 wherein said second moisturized cleaning surface harbors moisture within the material forming said second moisturized cleaning surface.

9. The golf towel of claim 1 further including a third cleaning surface on said first cleaning surface formed of an abrasive and roughened cleaning material.

10. The golf towel of claim 1 where in said connected edges include separable, fastener means forming a connection of said connected edges.

11. The golf towel of claim 1 further including rigid front and rear covers surrounding said first and second cleaning surfaces; said front and rear covers being foldable together, said cleaning surfaces being sandwiched therebetween.

12. The golf towel of claim 1 wherein said second moisturized cleaning surface is a sponge.

13. The golf towel of claim 1 wherein said second moisturized cleaning surface is an absorbent gel.

* * * * *